US005418520A

United States Patent [19]

Hirshberg

[11] Patent Number: 5,418,520

[45] Date of Patent: May 23, 1995

[54] CREDIT CARD ALERT SYSTEM

[76] Inventor: Israel Hirshberg, 4 Peretz Naftali Street, Petach Tikva, Israel, 49295

[21] Appl. No.: 973,147

[22] Filed: Nov. 6, 1992

[51] Int. Cl.[6] ..... G08B 13/14

[52] U.S. Cl. ..... 340/568; 340/692

[58] Field of Search ..... 340/568, 692

[56] References Cited

U.S. PATENT DOCUMENTS

| | | | |
|---|---|---|---|
| 3,959,789 | 5/1976 | McGahee | 340/568 |
| 4,692,745 | 9/1987 | Simanowitz | 340/568 |
| 4,857,897 | 8/1989 | Chen | 340/692 |
| 4,987,403 | 1/1991 | Apfel | 340/692 |

*Primary Examiner*—Glen Swann
*Attorney, Agent, or Firm*—Edwin D. Schindler

[57] ABSTRACT

An alert system reminds a credit card owner to collect his card after making payment. After a predetermined period of time the device will sound voices so as to attract the card owner to the absence of his card. Collecting the card and putting it back into its storage place will stop the voices, thus preventing the forgetting of the card after it was used.

The device comprises a voice programmable chip connected to a tiny loudspeaker and a switch which is operated when the credit card is removed from its place thus closing an electrical circuit which triggers a recorded period of silence after which the recording produces a voice to attract the owner's attention to his credit card.

The voice can be of any kind such as: human voice words, or a melody.

13 Claims, 4 Drawing Sheets

CREDIT CARD ALERT SYSTEM

BACKGROUND OF THE INVENTION

This invention is intended to prevent the common phenomena where people tend to forget their credit card after they handed it for payment. Losing a credit card is a frustrating experience usually leading to the need to cancel the validity of the card before improper usage by an unauthorized persons. Apart from the direct cost of a new credit card there is the period of time required for issuing a new card. If this card is the only one for that person then the damage is significant, more so for tourists in a foreign country. By making the device according to the invention, tiny and slim, it can be added without inconvenience into a regular wallet or credit card pocket or wallet , where credit cards are kept.

Devices of this kind are described in U.S. Pat. Nos. 5,034,724, 4,890,094, 4,794,378, 4,719,453, 4,717,908, 4,652,865 and 4,480,250. All of these patents incorporate buzzers that sound loud alarm tones. Such alarms are irritating to most people thus preventing these devices from becoming more widespread which would no doubt prevent the phenomena of forgetting credit cards.

The advantage of the present invention is the usage of a voice microchip which can be recorded to store and to re-play any human words in any language thus having the desired effect of attracting credit card owners to collect their card after making the payment.

SUMMARY OF THE INVENTION

The invention disclosed here is an alert system comprising a voice programmable microchip connected to a tiny loud-speaker and an electronic timer. This electronic device is connected to tiny batteries similar to those used in electronic watches. The device is switched on by pulling out the credit card from its place where the said device is installed.

After a predetermined span of time the timer supplies electric current to the voice generating microchip which transmits vibrated electric current to a loud-speaker which transform this electrical vibration into voices loud enough to be heard by the credit card owner even in a noisy place. The programmed chip can sound music or a human voice with specific words in any desired language intended to draw the attention of the credit card owner. This message will stop only when the credit card is put back into its place. This device can be programmed to function without a timer in order to save money by recording a few seconds of silence before the message itself, however it is more convenient with the timer.

DETAILED DESCRIPTION

Figure 1:
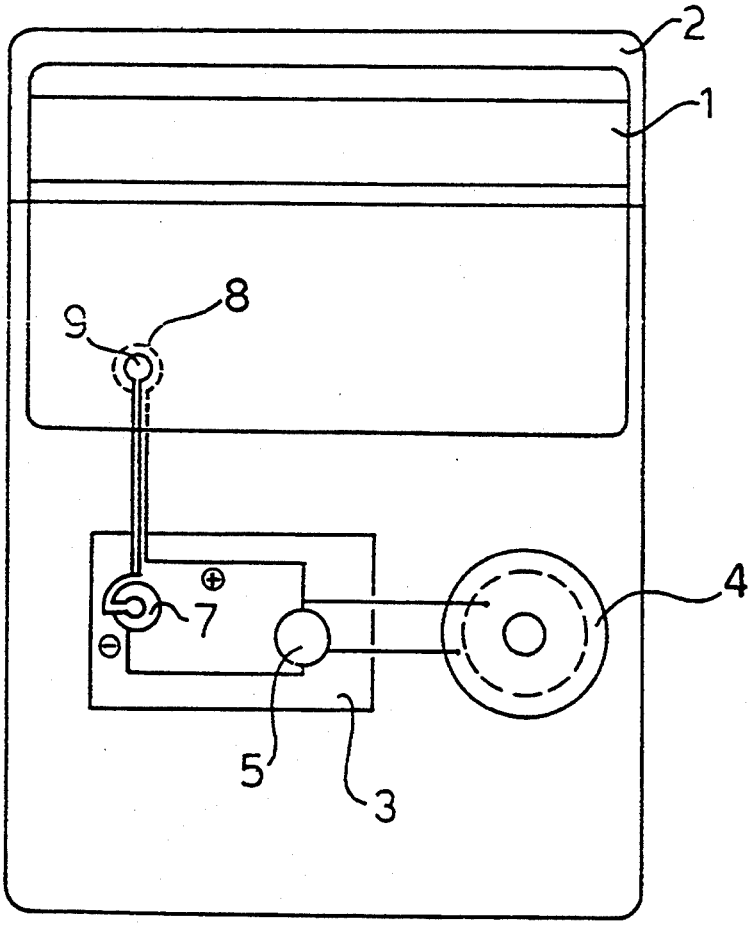
FIG. 1 shows a credit card case with the alarm system installed.
Figure 2:
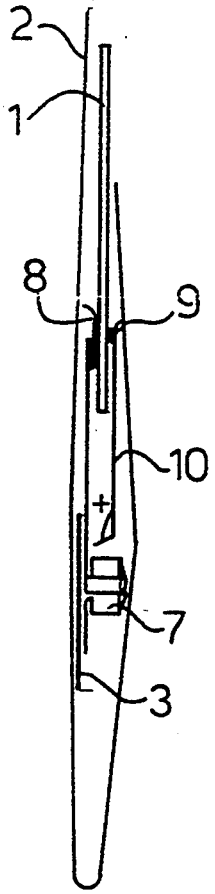
FIG. 2 is a sectional view of the case shown in FIG. 1 showing how the credit card separates two contacts while in its place.
Figure 3:
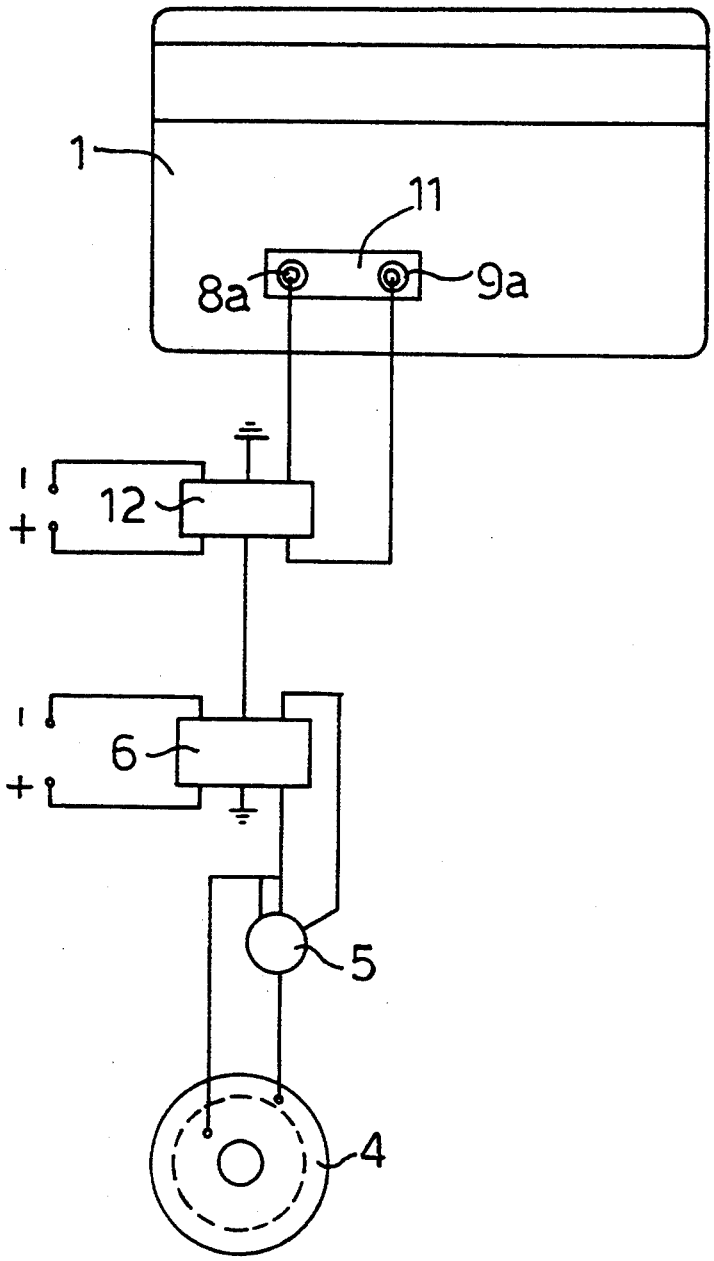
FIG. 3 shows a different embodiment of the invention where the two contacts are at the same side of the card touching a ribbon of conducting film attached to the credit card.

FIGS. 1 and 2 show schematically a preferred embodiment of the invention. A credit card 1 is put in its case 2 having the contacts 8 and 9 to be separated. An electronic circuit on a board 3 connects voice programmable microchip 5 with an optional timer 6 and a battery 7(see, FIGS. 3 and 4), the circuit is closed when the credit card is taken out,thus the two contacts 8 and 9 are touch each other because the springy bar 10 pushes contact 9 to touch contact 8, thus closing the circuit which triggers the timer to count the predetermined time span which afterward causes the electrical current to activate the microchip 5. The microchip 5 sends its stored programmed memory voices to the loud-speaker 4 by a vibrated electrical current into sounds loud enough to be heard by the owner even in a noisy place. The microchip 5 can be programmed to store a melody, a song or words in human voice in any desired language. After the card is taken from the case and a predetermined span of time has elapsed the device will sound voices, to draw the attention of the card owner to the fact that the card is not in its place. Usually the microchip 5 can be accompanied by electronic components in order to amplify its output. FIG. 2. is a cross section through the case and the card inside it. It shows that the overall thickness of the device is slim enough to be carried in a common wallet. FIG. 3. shows an alternate embodiment of the invention. Here two contacts **8*a* and 9*a* are at same side of the card lying in contact with a ribbon of electrical conductive film 11 attached to the card at a specific location. As long as the two contact points touch the ribbon 11 the device is at rest. When the card is taken out the timer is triggered to count the predetermined time and after this time has elapsed the timer connects the voice microchip 5 with the battery 7 to sound a recorded message (see, also, FIG. 4). In this embodiment only a card equipped with the conductive ribbon 11 in a unique place can connect contacts 8*a* and 9*a* to stop the device from producing the alarm, thus the device "knows" its card and this can prevent the case where a person received someone's else card instead of his own card. The entire device is not shown in FIG. 3 because it is very much the same as in FIG. 1 except that the triggering mechanism 12**, there is a transistorized switch connected to the battery and to the contact points circuit. When the contact points circuit is open by taking the card out, the switch is triggered and emits an electrical current to the timer which in turn connects the microchip with the battery to cause it to produce its stored programmed voices.

It is possible to program the said microchip 5 with the name of the person who owns the credit card, thus increasing the effect of the alerting voice. It is also possible to add a light emitting diode (LED) to monitor the battery status. Another possible improvement is to let the device to make a short time sound (a beep) to confirm that the battery is sufficiently charged.

Figure 4:
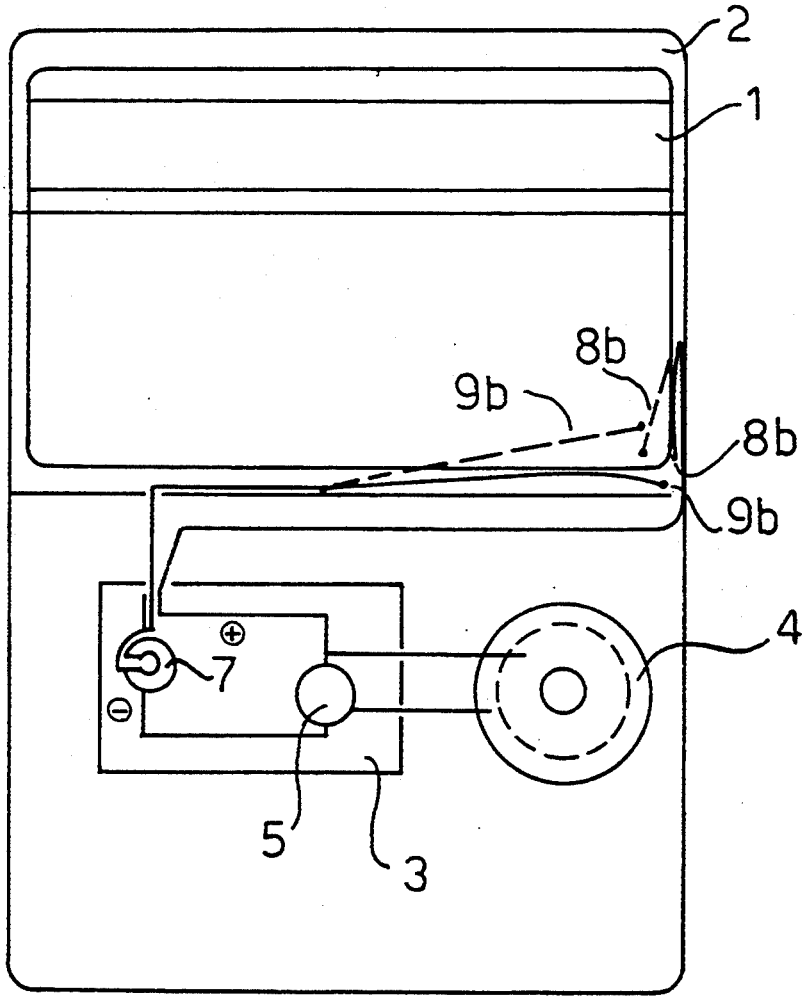
FIG. 4 shows an alternative arrangement of contact points closing the electric circuit when the card is absent.

FIG. 4 shows an alternate arrangement for the contact points **8*b* and 9*b***. It is obvious that many other arrangements for sensing the absence of the card are possible. The description of the electronics here is simplified and any professional in the field of electronics can design the details of such electronic device.

Figure 5:
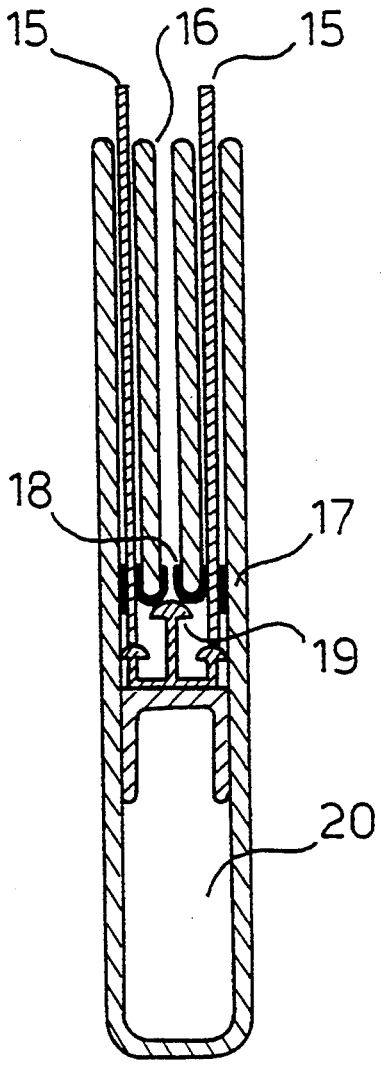
FIG. 5 shows a section through a credit-card holder designed for three cards.

FIG. 5 shows a credit-card holder designed for three cards. By using the same principals, it is easy to design a holder for any desired number of cards.

Two cards 15 are shown while one card is missing from its place 16. Each place for a card has its own springy bar 19 made of metal. When a card is removed from its place the springy bar 19 moves towards the metal films 17, 18 attached to the walls of the holder, thus closing the electrical circuit and activating the voice micro chip. The compartment 20 is dedicated for all the electrical components such as voice micro chip, battery, and loud speaker. They are not shown here for the sake of clarity.

Figure 6:
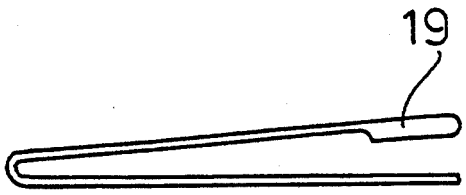
FIG. 6 shows a side view of the spring bar from FIG. 6.

FIG. 6 is a side view of the spring bar 19, here it is shown in uncompressed status.

I claim:

1. An alert system for a wallet or credit card holder is which credit cards are carried, adapted to sound an audible warning after a predetermined period of time has elapsed from withdrawal of a credit card from said wallet or credit card holder, when the credit card withdrawn is not reinstated into said wallet or said credit card holder before expiration of said predetermined period of time, said alert system comprising, in combination: voice generating means, voice amplifying means, power supply means for said voice generating means and said voice amplifying means, said voice generating means including a recording in which a period of silence is provided on said recording for providing a time delay before sounding recorded music or a human voice; and, means for sensing the withdrawal and reinstatement of said credit card.

2. An alert system for a wallet or credit card holder in which credit cards are carried, adapted to sound an audible warning after a predetermined period of time has elapsed from withdrawal of a credit card from said wallet or credit card holder, when the credit card withdrawn is not reinstated into said wallet or said credit card holder before expiration of said predetermined period of time, said alert system comprising, in combination: voice generating means, voice amplifying means, power supply means for said voice generating means and said voice amplifying means; and, means for sensing the withdrawal and reinstatement of said credit card, wherein a period of silence is provided on a recording operable in conjunction with said voice generating means, thereby providing a time delay before sounding recorded music or a human voice, said time delay being used instead of using a timer device.

3. The alert system according to claim 2, wherein said voice generating means include a record/playback electronic microchip capable of generating a human voice or music, said voice generating means being connected to said voice amplifying means.

4. The alert system according to claim 3, wherein said voice amplifying means is a miniature loudspeaker.

5. The alert system according to claim 3, wherein said microchip is programmable for sounding any specific voice and desirable words in any language.

6. An alert system for a wallet or credit card holder in which credit cards are carried, adapted to sound an audible warning after a predetermined period of time has elapsed from withdrawal of a credit card from said wallet or credit card holder, when the credit card withdrawn is not reinstated into said wallet or said credit card holder before expiration of said predetermined period of time, said alert system comprising, in combination: voice generating means, voice amplifying means, power supply means for said voice generating means and said voice amplifying means; and, means for sensing the withdrawal and reinstatement of said credit card, wherein a few seconds of silence are recorded at the beginning of a recording on a voice chip serving as said voice generating means, thus providing a time delay.

7. The alert system according to claim 6, wherein said voice generating means include a record/playback electronic microchip capable of generating a human voice or music, said voice generating means being connected to said voice amplifying means.

8. The alert system according to claim 7, wherein said voice amplifying means is a miniature loudspeaker.

9. The alert system according to claim 7, wherein said microchip is programmable for sounding any specific voice and desirable words in any language.

10. An alert system for a wallet or credit card holder, which sounds an audible verbal message or music if a credit card previously withdrawn is not reinstated in the wallet or credit card holder within a predetermined period of time, comprising voice or music generating means with a power supply, means for sensing the withdrawal of the credit card, leans for activating an alarm mechanism, means for sensing the return of the credit card and means for deactivating said alarm mechanism, said voice and music generating means including a recording-playback electronic voice microchip adapted for recording any verbal message or music, wherein a predetermined period of silence is recorded at the beginning of said recorded message or music, and further including a loudspeaker connected to said voice microchip for sounding said message or music.

11. The alert system according to claim 10, wherein the message is an advertisement.

12. The alert system according to claim 10, wherein the message is an instruction.

13. The alert system according to claim 10, wherein the message is recorded with a human voice.

* * * * *